US005737807A

United States Patent [19]

Friedrich

[11] Patent Number: 5,737,807

[45] Date of Patent: Apr. 14, 1998

[54] ROTARY TABLE WITH A REDUCED FRICTION COVER PLATE

[75] Inventor: Hauner Friedrich, Ingolstadt, Germany

[73] Assignee: Rieter Ingolstadt Spinnereimaschinenbau AG, Ingolstadt, Germany

[21] Appl. No.: 64,091

[22] PCT Filed: Dec. 2, 1992

[86] PCT No.: PCT/EP92/02786

§ 371 Date: May 21, 1993

§ 102(e) Date: May 21, 1993

[87] PCT Pub. No.: WO93/11063

PCT Pub. Date: Jun. 10, 1993

[30] Foreign Application Priority Data

Dec. 4, 1991 [DE] Germany ..... 41 43 345.9
Oct. 5, 1992 [DE] Germany ..... 42 33 369.5

[51] Int. Cl.[6] ..... D04H 11/00

[52] U.S. Cl. ..... 19/159 R

[58] Field of Search ..... 19/157, 159 R, 19/159 A, 150; 100/82, 83, 84, 85

[56] References Cited

U.S. PATENT DOCUMENTS 3,736,625 6/1973 Johns ..... 19/159 R
4,646,390 3/1987 Bothner .
4,905,352 3/1990 Gunkinger et al. .
4,999,883 3/1991 Fritzsche et al. .
5,287,598 2/1994 Guntler et al. ..... 19/159 R

FOREIGN PATENT DOCUMENTS 0562866 6/1960 Belgium .

*Primary Examiner*—Clifford D. Crowder
*Assistant Examiner*—Michael A. Neas
*Attorney, Agent, or Firm*—Dority & Manning, P.A.

[57] ABSTRACT

A spinning plant preparation machine with a rotary plate for the depositing of fiber slivers in spinning cans, The basic body of the rotary plate is a casting, A cover is attached to the underside of the rotary plate, The cover is a cover plate which is presented in different, prefabricated states and is to be attached to the rotary plate.

8 Claims, 5 Drawing Sheets

ROTARY TABLE WITH A REDUCED FRICTION COVER PLATE

BACKGROUND OF THE INVENTION

The present invention relates to a spinning plant preparation machine with a rotary plate for the depositing of fiber slivers in spinning cans. The rotary plate rotates around its vertical axis and delivers the fiber sliver via an eccentrically located outlet of a sliver guiding channel in cycloidal loops into a rotating spinning can.

As the spinning can fills up, the forming fiber sliver mushroom presses against the rotary plate. The fiber sliver compression increases through the rotary plate as a function of the degree of fullness of the can. Friction occurs between the lower surface of the rotary plate and the fiber sliver filling the spinning can pressed against this lower surface. A faultless lower surface of the rotary plate is necessary so that the fiber sliver may not be damaged. The lower surface of the rotary plate is influenced by the finishing of the rotary plate.

The basic body of the rotary plate is made by casting, e.g. of cast aluminum. The rough lower surface of the rotary plate must subsequently be ground in additional operational steps. After this, the surface was polished to be then eloxated or chromated. This surface treatment of the lower surface was necessary in order to minimize the friction against the fiber sliver filling which presses against it.

Since the cast material contains very small bubbles it may often happen that bubbles are released as the surface is ground off, so that more grinding is necessary. Grinding can often lead to dimensions that fall below tolerance. This means that the rotary plate is rejected. These disadvantages are to be eliminated by the present invention.

OBJECTS AND SUMMARY OF THE INVENTION

It is a principal object of the instant invention to reduce defects in the production of rotary plates. Additional objects and advantages of the invention will be set forth in part in the description which follows, and in part will be obvious from the description, or may be learned by practice of the invention.

According to the present invention, a covering is attached to the underside of the rotary plate (i.e. on the side towards the spinning can) to cover the surface of the underside. The covering consists of a cover plate which is presented in a varying state of prefabrication and is to be attached to the rotary plate. The cover plate is circular (a disk) and is flush with the underside of the rotary plate, i.e. it is congruent. In this case threaded bolts are provided on the side of the cover plate towards the rotary plate. The cover plate is screwed to the rotary plate. It is a further characteristic that the cover plate (without threaded bolts) may be glued or otherwise attached to the underside of the rotary plate.

It is yet another characteristic that the cover plate is also circular, but has a slightly greater diameter than the rotary plate. The cover plate is in contact with the rotary plate. The border of the cover plate projecting beyond the rotary plate is angled off and the angled border is caused to engage the ring groove of the rotary plate and is thus attached.

It is a further characteristic of the invention that a prefabricated cover plate is placed on the underside of the rotary plate and is then connected interlockingly with the rotary plate. It is hereby characteristic that the cover plate is already prefabricated with an angled border and is placed on the rotary plate, so that the border is then caused to engage the ring groove of the rotary plate.

The reduction of the manufacturing outlay required in the past due to grinding, polishing and eloxating or chromating of the underside is an advantage of the invention. It is furthermore possible to lower the defects and thus, rejection rate of rotary plates since possible bubbles in the material of the rotary plate are covered up.

The covering can be attached without any restriction to all sizes of rotary plates.

It is a further advantage of the present invention that the possibility of selecting the material of the covering may make it possible to achieve uniformity of surface characteristics, such as does not exist in the rotary plate. This situation is advantageous to the fiber sliver mushroom during can removal below the rotary plate.

Another advantage of the invention results in connection with the integration of sliver channel into the rotary plate. Less care is required in casting the sliver channel into the cast mass of the rotary plate.

The invention is described below through the accompanying drawings.

DETAILED DESCRIPTION OF THE PREFERRED EMBODIMENTS

Figure 1:
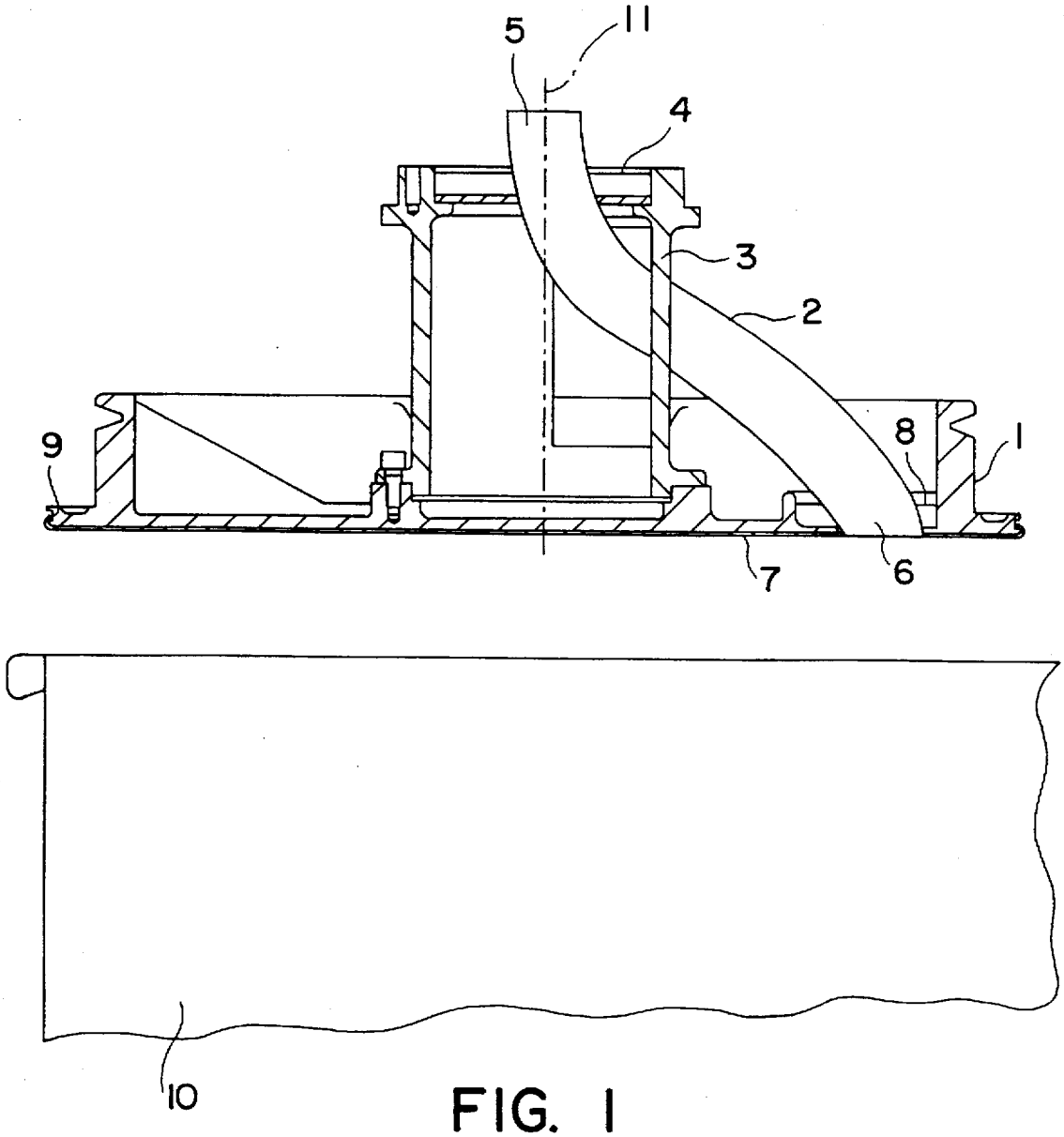
FIG. 1 shows a rotary plate and spinning can in a longitudinal section.

Reference will now be made in detail to the presently preferred embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. The numbering of components in the drawings is consistent throughout the application, with the same components having the same number in each of the drawings.

According to FIG. 1, the rotary plate 1 is installed in a spinning plant preparation machine (not shown), e.g. in a draw frame or a carder. The fiber sliver enters the intake 5 of the sliver channel 2, passes through the sliver channel 2 and emerges from the sliver channel 2 at outlet 6. The sliver channel is centered in the rotary plate 1. The rotary plate rotates around a rotational axis 11 during the depositing of the fiber sliver. The rotation of the rotary plate 1 around the rotational axis 11 produces a circular deposit of the fiber sliver in a can 10. With the can 10 rotating at the same time, the fiber sliver is deposited in a cycloid form in can 10 so that the spinning can 10 can be filled more uniformly and completely with the fiber sliver.

A cast mass 4 connects the sliver channel 2 to a table holder 3. This ensures that the sliver channel is always positioned correctly and does not change its position as a result of external influences. The sliver channel 2 is also fixed at its outlet 6 by means of a cast mass 8. The cast mass 8 ensures a gap-free passage between the sliver channel 2 and the rotary plate 1 or the covering 7 on the underside of the rotary plate. The underside of the rotary plate 1 is provided with a covering 7. The covering 7 is made of a material which produces little friction against the fiber sliver, preferably special steel, brass or ceramic. In addition to extremely reduced friction, this also ensures low wear of the covering 7. In addition, expensive machining of the bottom of the rotary plate 1, in particular grinding and polishing on the underside of the rotary plate 1, is avoided. Furthermore, less care is required in casting the sliver channel 2 and the cast mass 8 in the rotary plate, since the casting flues are covered by the covering 7 in such manner that only the free cross-section of the sliver channel remains free. Furthermore, only one casting mold is needed for the different diameters of the sliver channels. As FIG. 1 furthermore shows, covering 7 is intimately pressed against the underside of the rotary plate. The basic body of the rotary plate 1 is made of cast aluminum. The lower surface of the rotary plate towards the spinning can 10 is no longer polished and is no longer eloxated or chromated.

Figure 2:
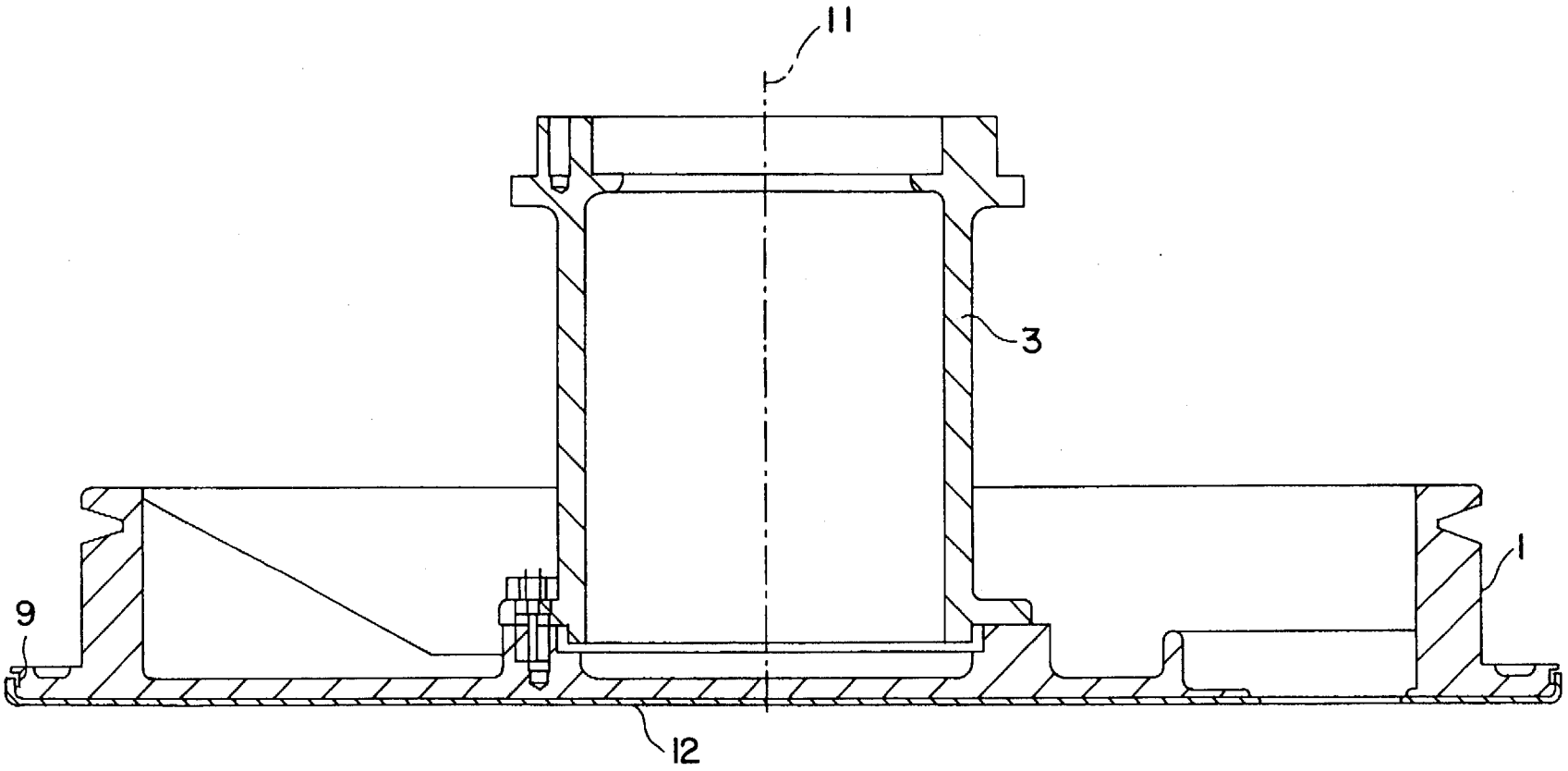
FIG. 2 shows a prefabricated cover plate set on the rotary plate.
Figure 2A:
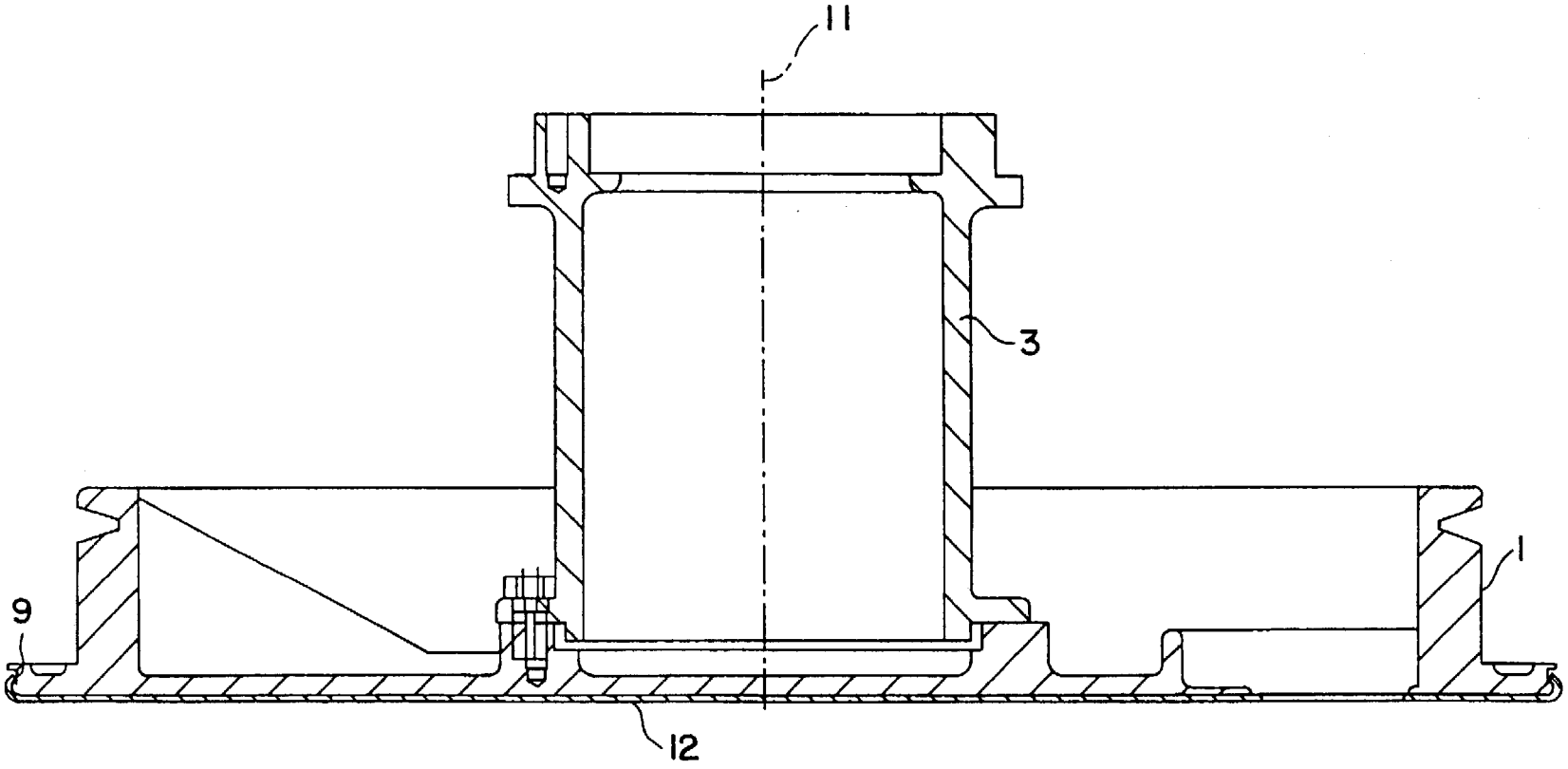
FIG. 2*a* shows a prefabricated cover plate engaging the ring groove of the rotary plate.

According to FIG. 2, a prefabricated cover plate 12 is placed on the rotary plate 1. This cover plate 12 has an angled border and is set flush on the rotary plate 1. The cover plate 12 is attached to the rotary plate 1 in that the angled border is caused to engage the ring groove 9 of the rotary plate 1. FIG. 2*a* shows the attachment of the cover plate 12.

Figure 3:
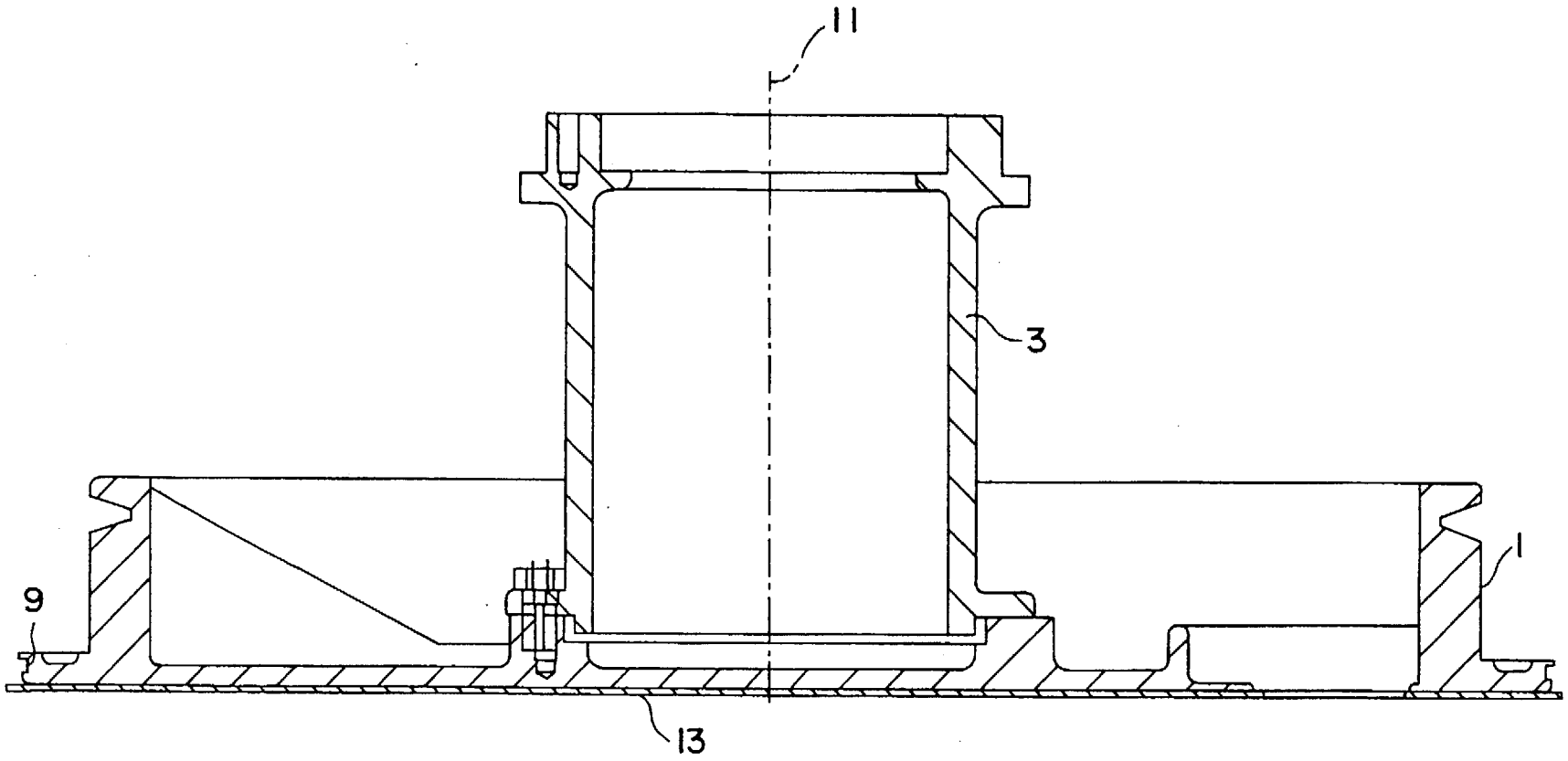
FIG. 3 shows a circular cover plate set on the rotary plate.
Figure 3A:
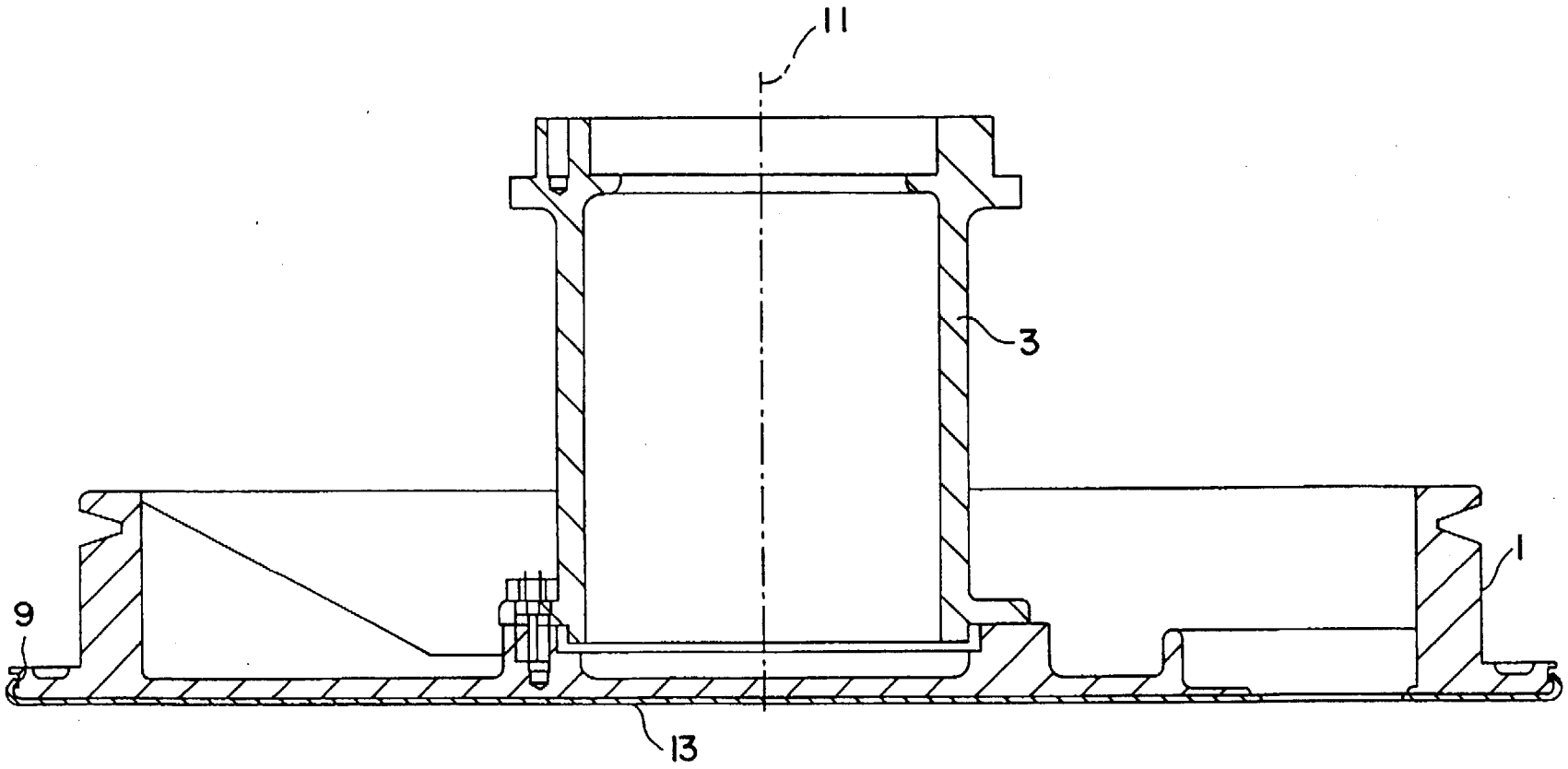
FIG. 3*a* shows the angle cut and engagement of the border of the cover plate in the ring groove of the rotary plate.

In another embodiment according to FIG. 3, only a prefabricated circular cover plate 13 is placed on the underside of the rotary plate 1. It is characteristic here that this cover plate 13 has a slightly greater diameter than the rotary plate 1. In a following manufacturing step the circular cover plate 13 must be angled off and the angled border must at the same time engage the ring groove 9 of the rotary plate. The cover plate 13 is thus permanently fixed (see FIG. 3*a*.)

It is an additional characteristic of the invention that the cover plate is circular and closes flush with the underside of the rotary plate, i.e. it is congruent. This cover plate is in the form of a disk. This is not shown in a drawing. In this case threaded bolts are provided on the side of the cover plate towards the rotary plate. The threaded bolts of the cover plate are introduced into bores of the rotary plate (which must be made specially for this purpose) and are secured by screwing on the back of the rotary plate.

The attachment of the cover plate by gluing is another characteristic of the invention. The cover plate is in this form a disk and is flush with the lower edge of the rotary plate. The cover plate is glued to the underside of the rotary plate.

The cover plate 7, 12, 13 is preferably made of special steel. If the cover plate is a disk which registers flush with the underside of the rotary plate it is also possible to use a ceramic material for the cover plate.

The surface of each cover plate coming into contact with the fiber sliver is structured. It is an orange-peel or scarred-leather structure, so that an effect of adhesion by suction of the fibers of the deposited fiber sliver against the cover plate is prevented.

It will be apparent to those skilled in the art that various modifications and variations can be made in the present invention without departing from the scope or spirit of the invention. It is intended that the present invention cover such modifications and variations as come within the scope of the appended claims and their equivalents.

I claim:

1. A rotary plate for a spinning plant preparation machine, said rotary plate for delivering fiber sliver through a sliver channel defined therethrough into a sliver can, said rotary plate comprising an underside with a non-machined rough surface, and a cover fitted flush upon said underside, said cover being formed of a material selected to substantially reduce friction between said cover and fiber sliver built up in a sliver can placed under said cover, said rotary plate underside further including a ring groove defined therearound, said cover comprising a cover plate having a diameter slightly greater than that of said rotary plate underside, the portion of said cover plate diameter extending beyond said rotary plate underside being formed so as to engagingly lock with said ring groove.

2. The rotary plate as in claim 1, wherein said cover plate comprises a prefabricated plate having an angled border for engagingly locking with said ring groove.

3. The rotary plate as in claim 1, wherein said rotary plate underside includes bores defined therethrough and said cover comprises threaded bolts formed thereon which extend through said bores, said cover being attached to said rotary plate through said bolts.

4. The rotary plate as in claim 1, wherein said cover is glued to said rotary plate underside.

5. The rotary plate as in claim 1, wherein said cover is formed of a steel selected to substantially reduce friction between said cover and fiber sliver built up in a sliver can placed under said cover.

6. The rotary plate as in claim 1, wherein said cover is formed of a ceramic material selected to substantially reduce friction between said cover and fiber sliver built up in a sliver can placed under said cover.

7. The rotary plate as in claim 1, wherein the surface of said cover facing opposite of said rotary plate is a structured surface for reducing adhesion of fibers thereto.

8. The rotary plate as in claim 7, wherein said structured surface is an orange-peel like textured surface.

* * * * *